US007913863B2

(12) United States Patent
Lin

(10) Patent No.: US 7,913,863 B2
(45) Date of Patent: Mar. 29, 2011

(54) SHELVING UNIT WHOSE SUPPORT BOARD IS IN QUICK AND EASY ASSEMBLY

(76) Inventor: Shih-Ming Lin, Dongguan (CN)

( * ) Notice: Subject to any disclaimer, the term of this patent is extended or adjusted under 35 U.S.C. 154(b) by 144 days.

(21) Appl. No.: 12/391,457

(22) Filed: Feb. 24, 2009

(65) Prior Publication Data

US 2010/0122965 A1 May 20, 2010

(30) Foreign Application Priority Data

Nov. 19, 2008 (CN) ..... 2008 2 0203673

(51) Int. Cl.
*A47B 43/00* (2006.01)

(52) U.S. Cl. ..... 211/186; 211/189; 312/263; 403/349

(58) Field of Classification Search ..... 211/186, 211/189; 312/7.2, 257.1, 263; 108/101, 108/159.11, 193, 184 X; 403/348, 349, 353; 411/349, 549, 553
See application file for complete search history.

(56) References Cited

U.S. PATENT DOCUMENTS 270,579 A * 1/1883 Tray et al. ..... 108/155
603,162 A * 4/1898 Baker ..... 312/195
729,368 A * 5/1903 Loeffel ..... 312/263
759,728 A * 5/1904 Maxwell ..... 27/17
1,698,252 A * 1/1929 Ashe ..... 220/4.32
2,522,097 A * 9/1950 Cookson ..... 403/345
2,542,649 A * 2/1951 Flowers ..... 220/293
2,579,897 A * 12/1951 Blechman ..... 217/65
3,159,440 A * 12/1964 Courtwright ..... 312/263
3,765,077 A * 10/1973 Pabich ..... 29/432
3,835,354 A * 9/1974 Torres-Pena ..... 312/265.4
4,886,326 A * 12/1989 Kuzyk ..... 312/257.1
6,007,170 A * 12/1999 Liebertz et al. ..... 312/263

* cited by examiner

*Primary Examiner* — Korie Chan
(74) *Attorney, Agent, or Firm* — Alan Kamrath; Kamrath & Associates PA

(57) ABSTRACT

A shelving unit includes a support frame and at least one support board detachably mounted on the support frame. The support frame includes a back board which has at least one support rail which is provided with at least one locking slot. The shelving unit further comprises at least one locking knob mounted on the support board and detachably locked in the locking slot of the back board. The support board can be mounted on and detached from the support frame. Thus, the user only needs to rotate the locking knob to lock the support board onto the back board or to unlock the support board from the back board, so that the support board is mounted on and detached from the back board easily and quickly without using tools and saving a considerable amount of time for a user.

11 Claims, 7 Drawing Sheets

SHELVING UNIT WHOSE SUPPORT BOARD IS IN QUICK AND EASY ASSEMBLY

BACKGROUND OF THE INVENTION

1. Field of the Invention

The present invention relates to the quick and easy assembled support board on a shelving unit and, more particularly, to the quick and easy assembled support board on a shelving unit to display and store an electronic video or audio appliance, such as a television, video player, speaker and the like.

2. Description of the Related Art

A conventional shelving unit comprises a support frame and a plurality of support boards attached on the support frame to display or store articles, such as a television, video player, speaker and the like. Each of the support boards is attached to the support frame by a plurality of locking screws. However, a user has to in turn screw the locking screws into each of the support boards and the support frame so as to lock each of the support boards onto the support frame, thereby causing inconvenience to the user in assembly or disassembly of the shelving unit.

BRIEF SUMMARY OF THE INVENTION

In accordance with the present invention, there is provided a shelving unit, comprising a support frame and at least one support board detachably mounted on the support frame. The support frame includes a back board. The back board of the support frame has at least one support rail which is provided with at least one locking slot. The shelving unit further comprises at least one locking knob mounted on the support board and detachably locked in the locking slot of the back board.

The primary objective of the present invention is to provide a shelving unit that is assembled or disassembled easily and quickly without using tools.

Another objective of the present invention is to provide a shelving unit, wherein the support board can be mounted on and detached from the support frame, thereby facilitating a user mounting and removing the support board of the shelving unit.

A further objective of the present invention is to provide a shelving unit, wherein the user only needs to rotate the locking knob to lock the support board onto the back board of the support frame or to unlock the support board from the back board of the support frame, so that the support board is mounted on and detached from the back board of the support frame easily and quickly without using tools, thereby facilitating the user on assembling and disassembling the support board of the shelving unit quickly and easily.

A further objective of the present invention is to provide a shelving unit, wherein the user only needs to pivot the fastening snap to lock the support board onto the respective connecting unit of the support frame or to unlock the support board from the respective connecting unit of the support frame, so that the support board is mounted on and detached from the respective connecting unit of the support frame easily and quickly, thereby facilitating the user assembling and disassembling the support board of the shelving unit without using tools.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
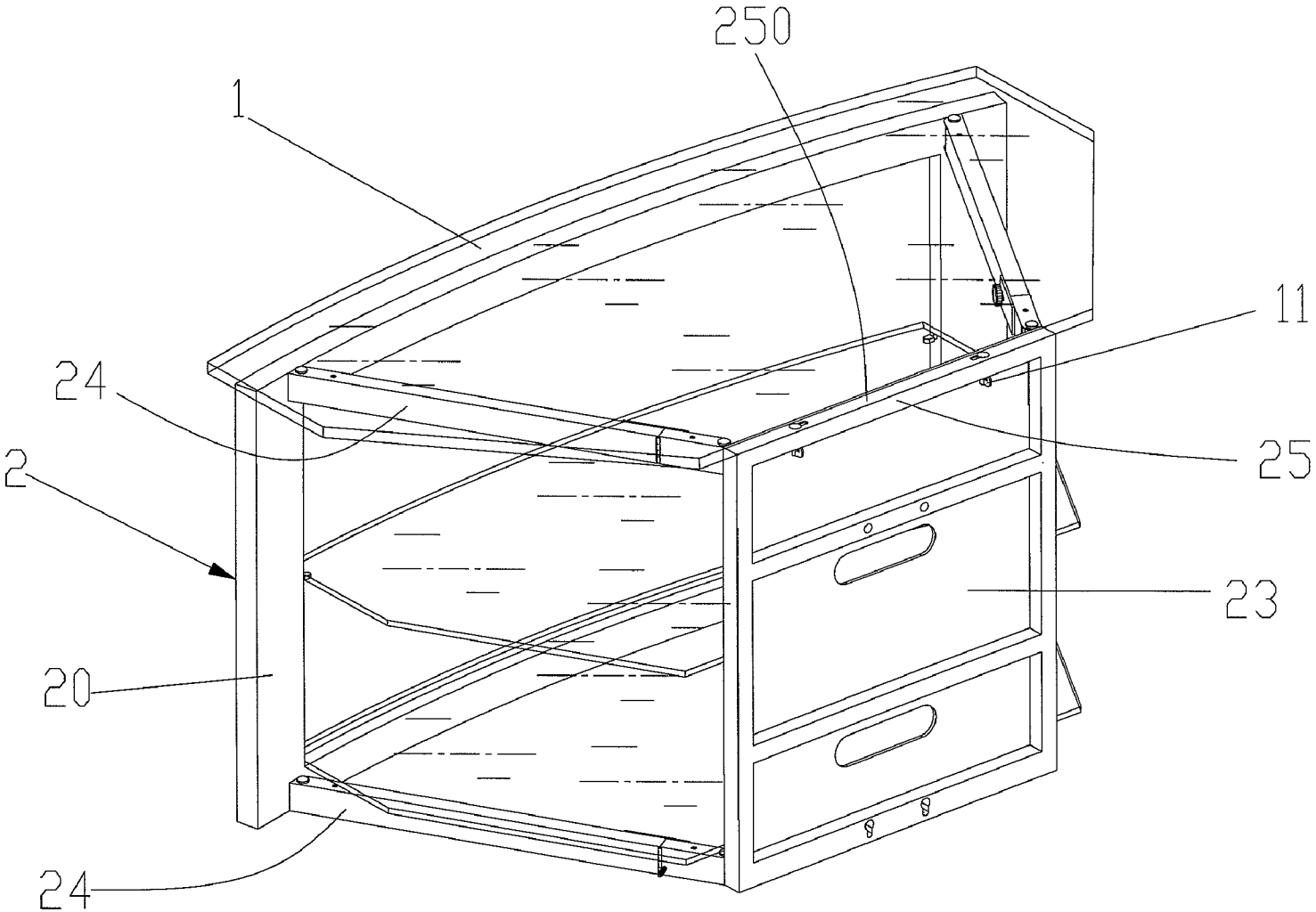
FIG. 1 is a perspective view of a shelving unit in accordance with the preferred embodiment of the present invention.

Referring to the drawings and initially to FIGS. 1-6, a shelving unit in accordance with the preferred embodiment of the present invention comprises a support frame 2, and at least one support board 1 detachably mounted on the support frame 2.

The support frame 2 includes a back board 23, a front support bracket 20 located opposite to the back board 23, and a plurality of connecting units 24 mounted between the back board 23 and the front support bracket 20.

The back board 23 of the support frame 2 has at least one support rail 25 which is provided with at least one locking slot 21. The support rail 25 of the back board 23 has a top 250 and a bottom 252. The locking slot 21 of the back board 23 extends through a whole thickness of the support rail 25 and extends from the top 250 to the bottom 252 of the support rail 25. Preferably, the support rail 25 of the back board 23 is provided with two locking slots 21.

The support board 1 is located between and supported by the front support bracket 20, the back board 23 and the connecting units 24 of the support frame 2. The support board 1 abuts the top 250 of the support rail 25 of the back board 23.

The shelving unit further comprises at least one locking knob 11 mounted on the support board 1 and detachably locked in the locking slot 21 of the back board 23. Preferably, the shelving unit comprises two locking knobs 11. The locking knob 11 is rotatably mounted on the support board 1. The locking knob 11 extends through the locking slot 21 of the back board 23 and protrudes outwardly from the bottom 252 of the support rail 25 of the back board 23. The locking knob 11 is rotatable relative to the support board 1 and the support rail 25 of the back board 23 between a first position as shown in FIG. 5 where the locking knob 11 aligns with and is flush with the locking slot 21 of the back board 23, so that the locking knob 11 is movable in the locking slot 21 of the back board 23, and the support board 1 is detachable from the back board 23, and a second position as shown in FIG. 6 where the locking knob 11 misaligns with the locking slot 21 of the back board 23 and is stopped by the bottom 252 of the support rail 25 of the back board 23, so that the locking knob 11 is locked onto the support rail 25 of the back board 23, and the support board 1 is locked onto the back board 23.

Figure 2:
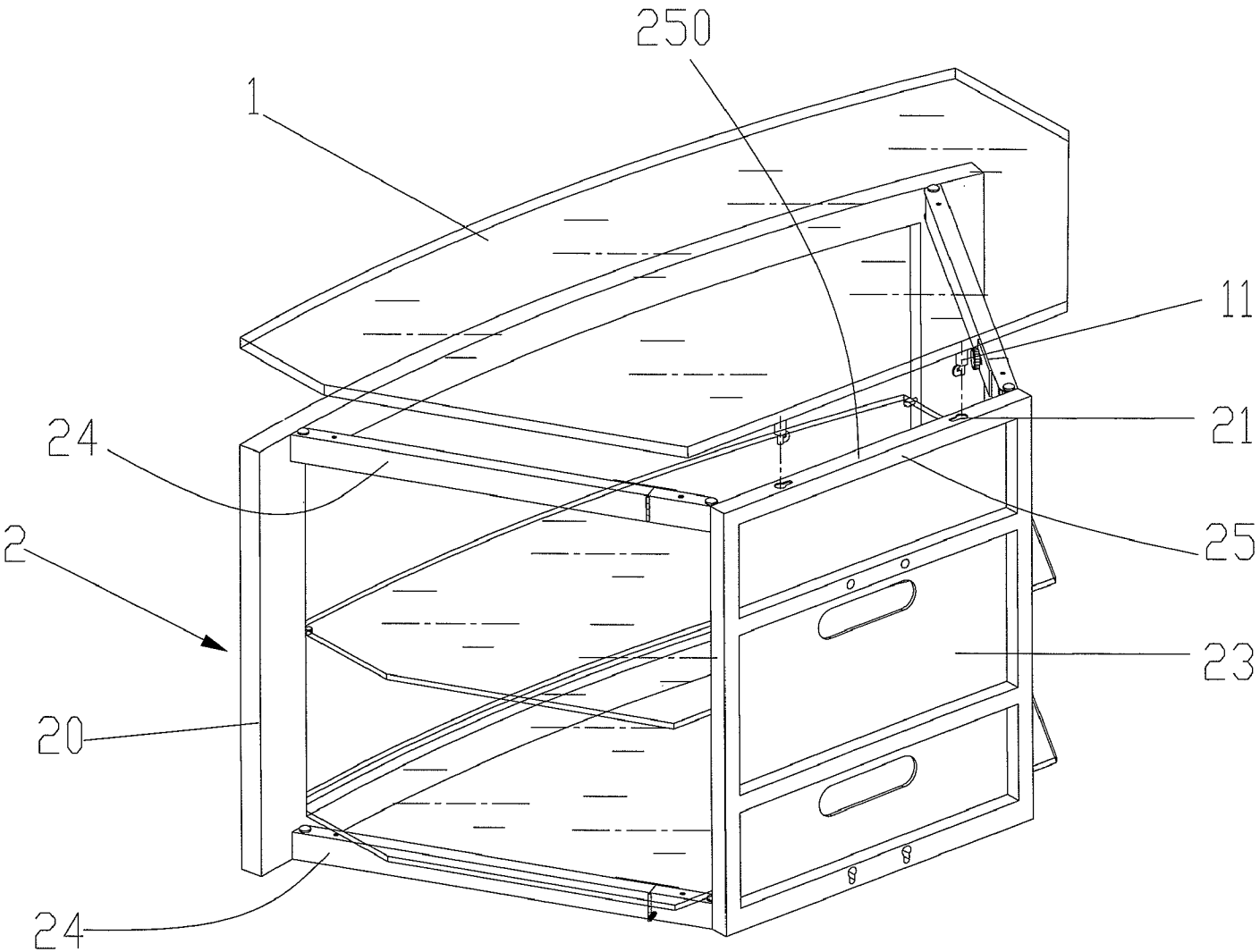
FIG. 2 is a partially exploded perspective view of the shelving unit as shown in FIG. 1.
Figure 3:
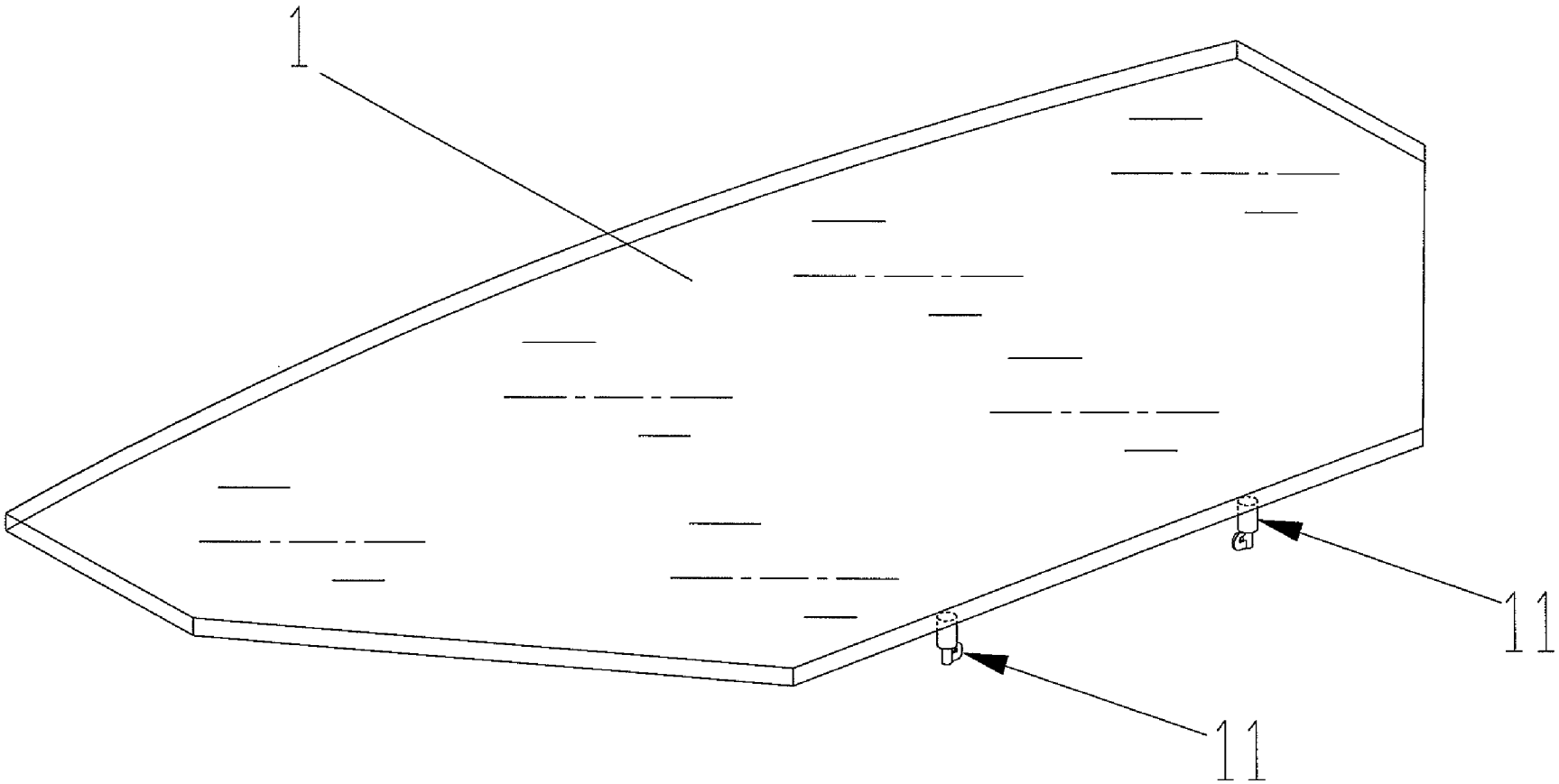
FIG. 3 is a perspective view of a support board of the shelving unit as shown in FIG. 2.
Figure 4:
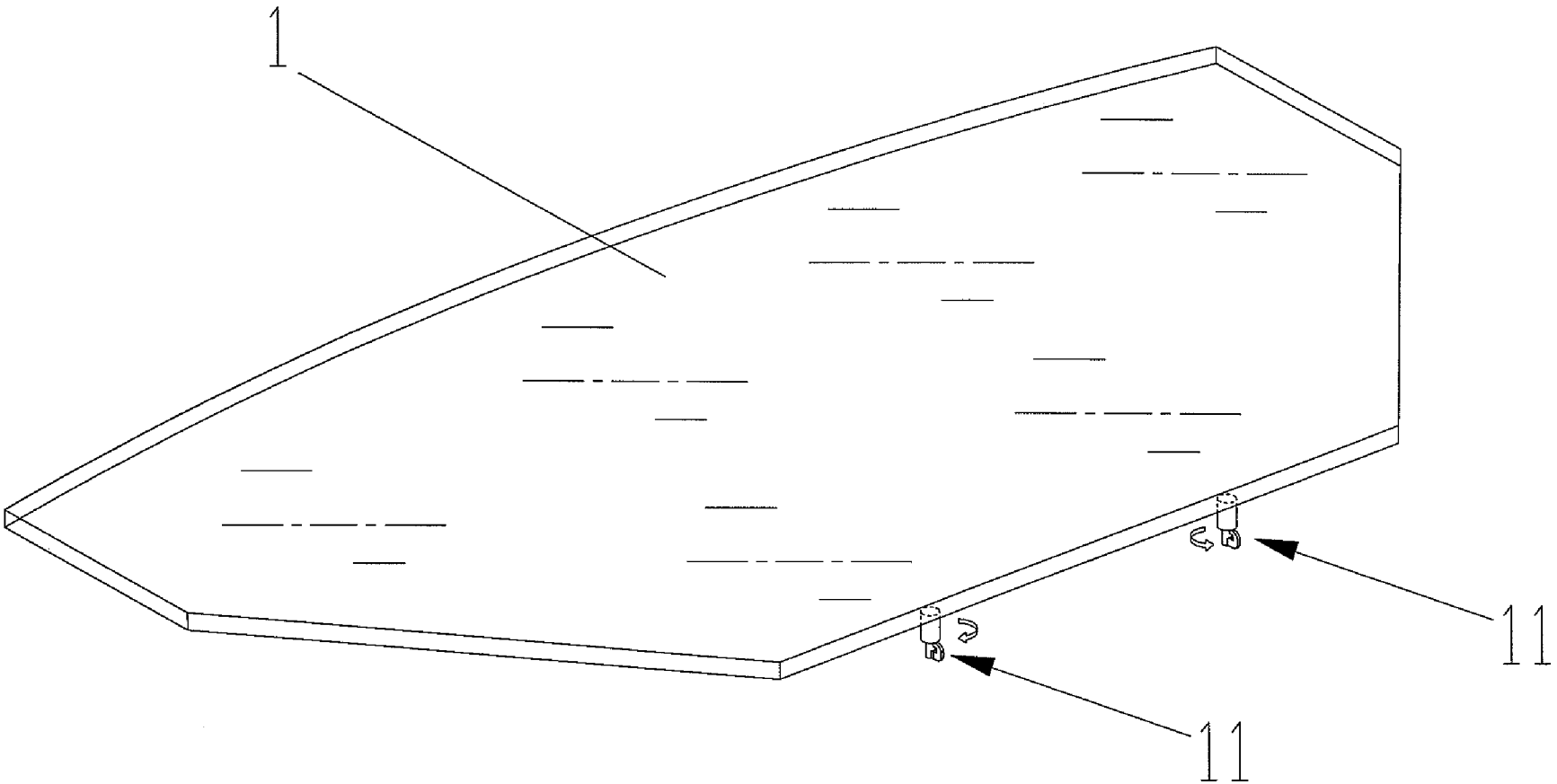
FIG. 4 is a schematic operational view of the shelving unit as shown in FIG. 3.
Figure 5:
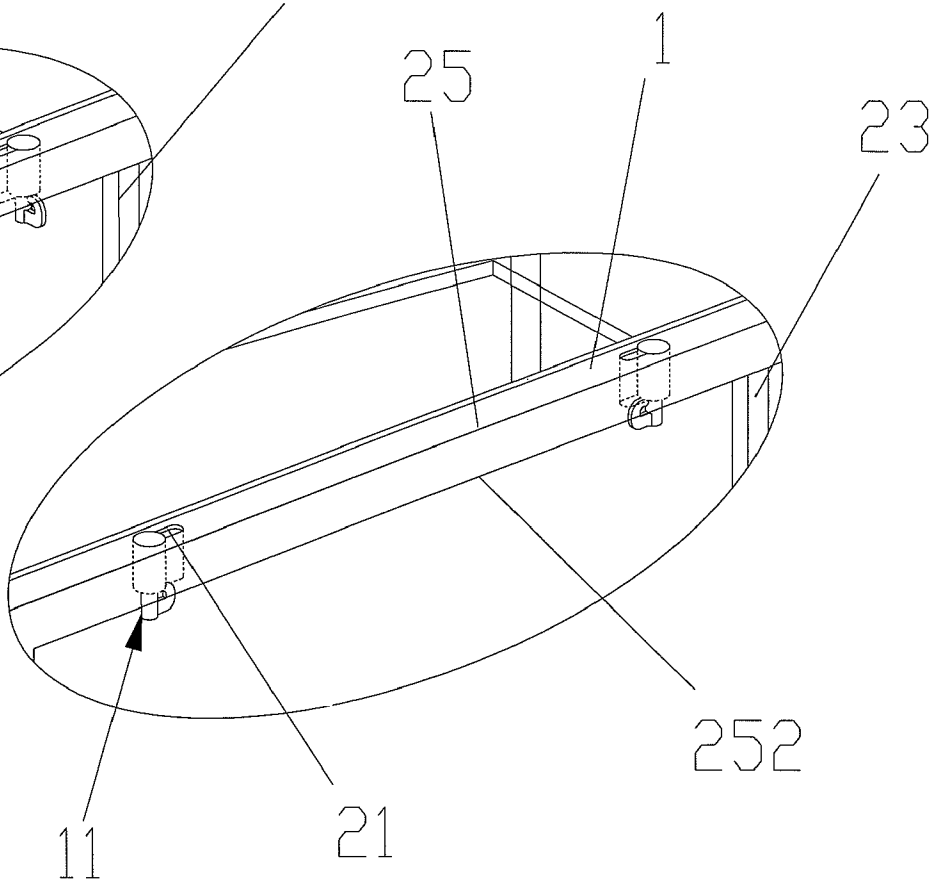
FIG. 5 is a locally enlarged perspective view of the shelving unit as shown in FIG. 1.
Figure 6:
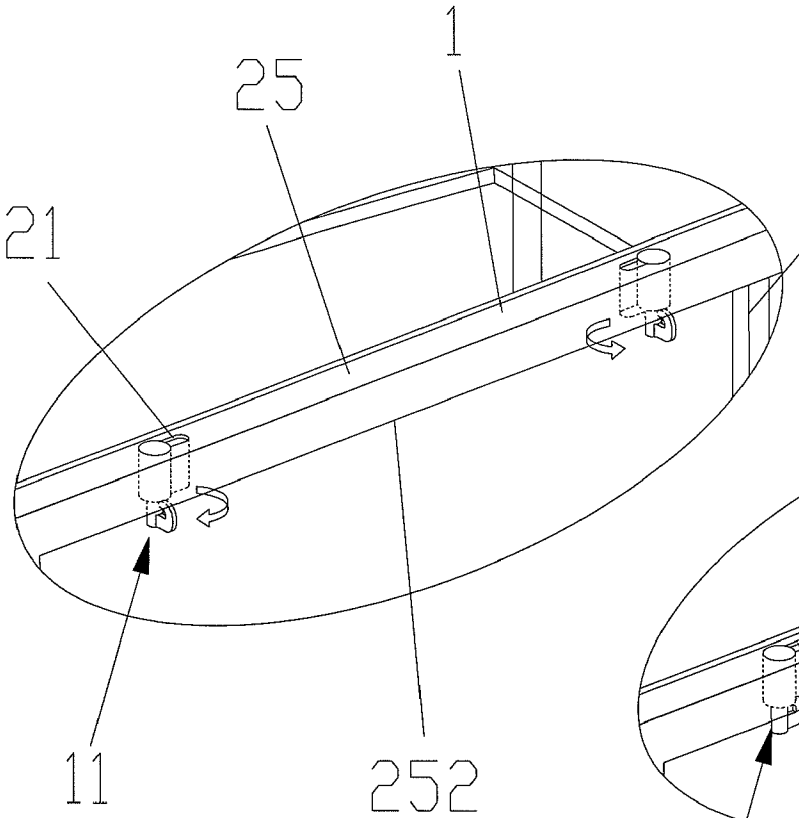
FIG. 6 is a schematic operational view of the shelving unit as shown in FIG. 5.
Figure 7:
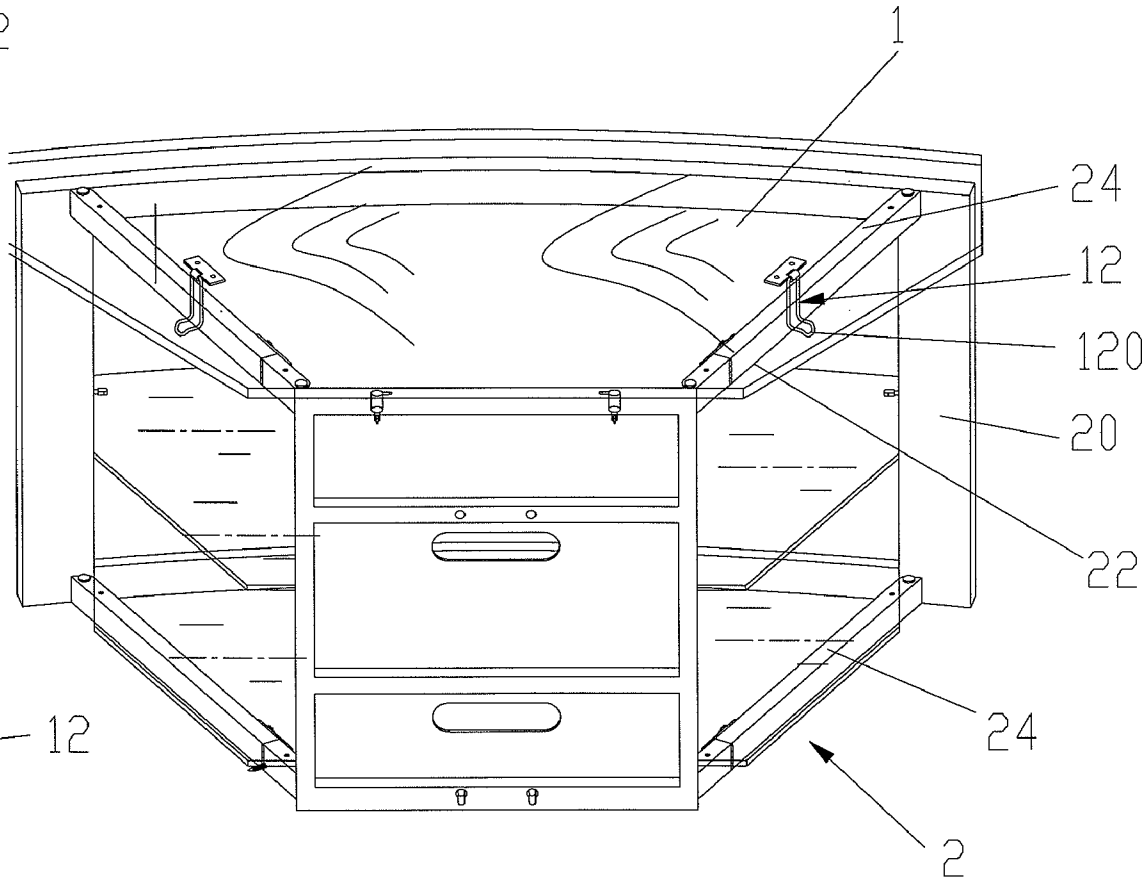
FIG. 7 is a perspective view of a shelving unit in accordance with another preferred embodiment of the present invention.
Figure 9:
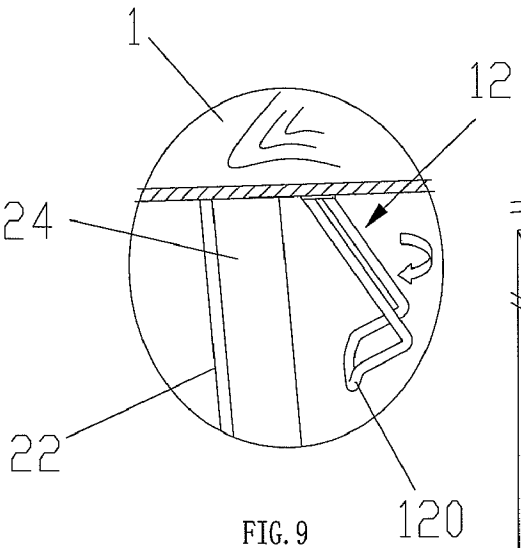
FIG. 9 is a locally enlarged perspective view of the shelving unit as shown in FIG. 7.
Figure 10:
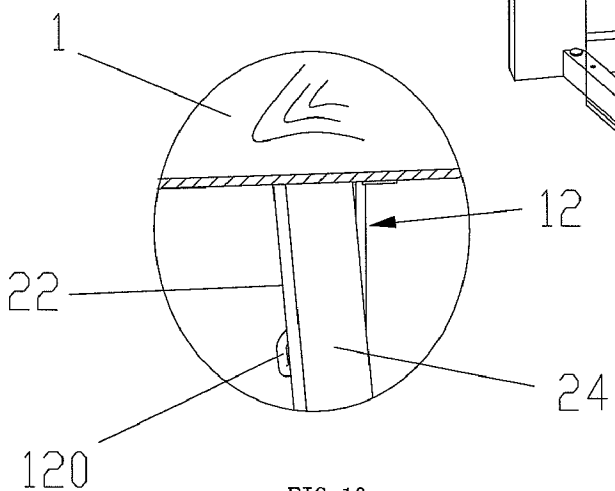
FIG. 10 is a schematic operational view of the shelving unit as shown in FIG. 9.
Figure 8:
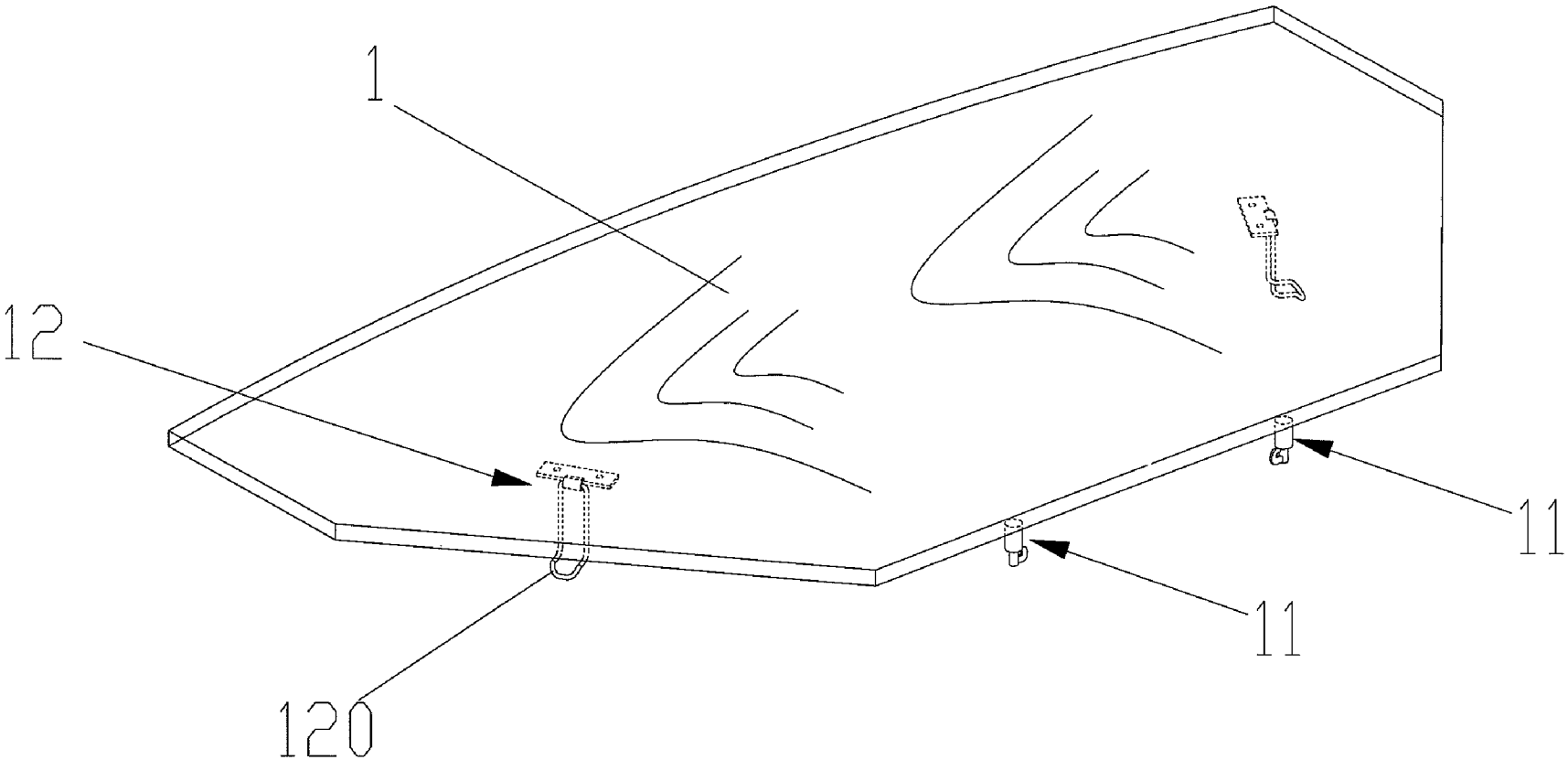
FIG. 8 is a perspective view of a support board of the shelving unit as shown in FIG. 7.

In operation, referring to FIGS. 3-6 with reference to FIGS. 1 and 2, when the support board 1 abuts the top 250 of the support rail 25 of the back board 23, the locking knob 11 aligns with and is flush with the locking slot 21 of the back board 23 as shown in FIG. 5, so that the locking knob 11 can extend through the locking slot 21 of the back board 23 and protrude outwardly from the bottom 252 of the support rail 25 of the back board 23. Then, when the locking knob 11 is rotated relative to the support rail 25 of the back board 23 through ninety degrees (90°), the locking knob 11 misaligns with the locking slot 21 of the back board 23 and is stopped by the bottom 252 of the support rail 25 of the back board 23 as shown in FIG. 6, so that the locking knob 11 is locked onto the support rail 25 of the back board 23, and the support board 1 is locked onto the back board 23.

On the contrary, when the locking knob 11 is rotated reversely relative to the support rail 25 of the back board 23 through ninety degrees (90°), the locking knob 11 aligns with and is flush with the locking slot 21 of the back board 23 as shown in FIG. 5 to unlock the locking knob 11 from the locking slot 21 of the back board 23, so that the locking knob 11 can be detached from the locking slot 21 of the back board 23, and the support board 1 can be detached from the back board 23.

Referring to FIGS. 7-10, the shelving unit further comprises at least one fastening snap 12 mounted on the support board 1 and detachably locked onto the respective connecting unit 24 of the support frame 2 to lock the support board 1 onto the respective connecting unit 24 of the support frame 2. Preferably, the shelving unit comprises two fastening snaps 12. The fastening snap 12 is pivotally mounted on the support board 1. The fastening snap 12 has a substantially L-shaped profile and has a bent distal end provided with a hook portion 120 that is detachably hooked onto a bottom 22 of the respective connecting unit 24.

Accordingly, the support board 1 can be mounted on and detached from the support frame 2, thereby facilitating a user mounting and removing the support board 1 of the shelving unit. In addition, the user only needs to rotate the locking knob 11 to lock the support board 1 onto the back board 23 of the support frame 2 or to unlock the support board 1 from the back board 23 of the support frame 2, so that the support board 1 is mounted on and detached from the back board 23 of the support frame 2 easily and quickly, thereby facilitating the user assembling and disassembling the support board 1 of the shelving unit. Further, the user only needs to pivot the fastening snap 12 to lock the support board 1 onto the respective connecting unit 24 of the support frame 2 or to unlock the support board 1 from the respective connecting unit 24 of the support frame 2, so that the support board 1 is mounted on and detached from the respective connecting unit 24 of the support frame 2 easily and quickly, thereby facilitating the user assembling and disassembling the support board 1 of the shelving unit without using tools.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A shelving unit, comprising:

a support frame;

at least one support board detachably mounted on the support frame; wherein the support frame includes a back board;

the back board of the support frame has at least one support rail which is provided with at least one locking slot;

the shelving unit further comprises at least one locking knob mounted on the support board and detachably locked in the locking slot of the back board; wherein the support rail of the back board has a top and a bottom;

the support board abuts the top of the support rail of the back board;

the locking knob extends through the locking slot of the back board and protrudes outwardly from the bottom of the support rail of the back board.

2. The shelving unit of claim 1, wherein the locking knob is rotatably mounted on the support board.

3. The shelving unit of claim 2, wherein the locking knob is rotatable relative to the support board and the support rail of the back board between a first position where the locking knob aligns with and is flush with the locking slot of the back board, so that the locking knob is movable in the locking slot of the back board, and the support board is detachable from the back board, and a second position where the locking knob misaligns with the locking slot of the back board and is stopped by the bottom of the support rail of the back board, so that the locking knob is locked onto the support rail of the back board, and the support board is locked onto the back board.

4. The shelving unit of claim 1, wherein the locking slot of the back board extends through a whole thickness of the support rail.

5. The shelving unit of claim 4, wherein the locking slot of the back board extends from the top to the bottom of the support rail.

6. The shelving unit of claim 1, wherein the support rail of the back board is provided with two locking slots;

the shelving unit comprises two locking knobs.

7. A shelving unit, comprising:

a support frame;

at least one support board detachably mounted on the support frame; wherein the support frame includes a back board;

the back board of the support frame has at least one support rail which is provided with at least one locking slot;

the shelving unit further comprises at least one locking knob mounted on the support board and detachably locked in the locking slot of the back board; wherein the support frame further includes:

a front support bracket located opposite to the back board;

a plurality of connecting units mounted between the back board and the front support bracket;

the shelving unit further comprises at least one fastening snap mounted on the support board and detachably locked onto the respective connecting unit of the support frame to lock the support board onto the respective connecting unit of the support frame;

the fastening snap is pivotally mounted on the support board.

8. The shelving unit of claim 7, wherein the fastening snap has a substantially L-shaped profile.

9. The shelving unit of claim 8, wherein the fastening snap has a bent distal end provided with a hook portion that is detachably hooked onto a bottom of the respective connecting unit.

10. A shelving unit, comprising:

a support frame;

at least one support board detachably mounted on the support frame; wherein the support frame includes a back board;

the back board of the support frame has at least one support rail which is provided with at least one locking slot;

the shelving unit further comprises at least one locking knob mounted on the support board and detachably locked in the locking slot of the back board; wherein the support frame further includes:

a front support bracket located opposite to the back board;

a plurality of connecting units mounted between the back board and the front support bracket;

the shelving unit further comprises at least one fastening snap mounted on the support board and detachably locked onto the respective connecting unit of the support frame to lock the support board onto the respective connecting unit of the support frame;

the shelving unit comprises two fastening snaps.

11. The shelving unit of claim 7, wherein the support board is located between and supported by the front support bracket, the back board and the connecting units of the support frame.

* * * * *